US006880643B1

(12) United States Patent
Zimmerman et al.

(10) Patent No.: US 6,880,643 B1
(45) Date of Patent: Apr. 19, 2005

(54) SYSTEM AND METHOD FOR LAND-LEVELING

(75) Inventors: Kurt R. Zimmerman, Mountain View, CA (US); Avi Gross, Palo Alto, CA (US); Michael O'Connor, Redwood City, CA (US); Glen Sapilewski, Redwood City, CA (US); David G. Lawrence, Mountain View, CA (US); H. Stewart Cobb, Palo Alto, CA (US); Lars Leckie, San Francisco, CA (US); Paul Y. Montgomery, Menlo Park, CA (US)

(73) Assignee: Novariant, Inc., Menlo Park, CA (US)

( * ) Notice: Subject to any disclaimer, the term of this patent is extended or adjusted under 35 U.S.C. 154(b) by 0 days.

(21) Appl. No.: 10/359,409

(22) Filed: Feb. 6, 2003

Related U.S. Application Data

(60) Provisional application No. 60/355,570, filed on Feb. 7, 2002, and provisional application No. 60/403,185, filed on Aug. 8, 2002.

(51) Int. Cl.[7] ..... E02F 3/76

(52) U.S. Cl. ..... 172/4.5; 701/50

(58) Field of Search ..... 172/2–9; 37/348; 701/50, 207, 209; 342/357.01, 357.17; 340/988, 990, 995

(56) References Cited

U.S. PATENT DOCUMENTS

| | | | | |
|---|---|---|---|---|
| 5,631,658 A | | 5/1997 | Gudat et al. | |
| 5,646,844 A | * | 7/1997 | Gudat et al. | 702/208 |
| 5,735,352 A | * | 4/1998 | Henderson et al. | 172/4.5 |
| 5,764,511 A | | 6/1998 | Henderson | |
| 5,955,973 A | * | 9/1999 | Anderson | 340/988 |
| 6,088,644 A | * | 7/2000 | Brandt et al. | 701/50 |
| 6,434,462 B1 | * | 8/2002 | Bevly et al. | 701/50 |

* cited by examiner

*Primary Examiner*—Robert E Pezzuto
(74) *Attorney, Agent, or Firm*—Brinks Hofer Gilson & Lione

(57) ABSTRACT

A land-leveling system that uses the Global Positioning System is provided. The system provides for an earth-moving machine mounted with an antenna that receives GPS signals from the satellites of the Global Positioning System. The earth-moving machine comprises a vehicle attached to a work implement, which is also connected to an actuator. A decision unit mounted on the vehicle sends control signals to the actuator, which controls the elevation of the work implement. These control signals are generated using the signals received from the antenna and the desired grade map. This system has an increased coverage area, more accuracy and round-the-clock operability. The system could be used to carry out all the land-leveling operations viz. surveying, leveling and verifying.

27 Claims, 3 Drawing Sheets

SYSTEM AND METHOD FOR LAND-LEVELING

REFERENCE TO RELATED APPLICATIONS

This application claims priority of U.S. Provisional applications Nos. 60/355,570 and 60/403,185 filed Feb. 7, 2002 and Aug. 8, 2002.

BACKGROUND

The present invention relates to land-leveling and deals more specifically with a system and method for land-leveling using the Global Positioning System (GPS).

Land-leveling is carried out for getting a desired surface and slope of the land. Proper leveling of land is crucial in agricultural farms as it ensures efficient water run-off and proper irrigation. It is also required in various other processes such as laying of railway lines and construction of buildings.

Leveling of land involves cutting as well as filling operations depending on the difference between the existing and the desired land profile. Various work implements like motor graders, dozers, compactors, pavers and profilers are available for land-leveling. A scraper is typically used for leveling in agricultural farms.

Land-leveling is traditionally carried out manually. This process consists of the following three steps: surveying, leveling and verification. The surveying process is used to construct maps of the terrain. It is carried out to identify the work areas before leveling.

The step of leveling includes the operations of cutting as well as filling: the areas that are at a higher level than the desired level are cut, while the areas that are at a lower level are filled with soil.

The verification step involves resurveying the leveled land to find the compliance of the leveled land with the desired grade map.

These three steps are performed repeatedly until the desired topography is attained. The steps of cutting and filling are based on the judgment of the operator. Hence, a large number of iterations are required to attain the desired terrain. This makes the entire process highly time consuming. Moreover, to obtain acceptable accuracy levels, highly trained personnel need to be employed.

To eliminate the abovementioned drawbacks, various systems based on ultrasound and laser have been proposed. Laser-based systems consist of a swept laser beam that forms a reference laser plane. The laser plane is so adjusted that it aligns itself with the desired terrain. The sensors attached to the blades of the scraper sense the laser plane. This information is displayed to an operator who manually adjusts the height of the implement within an acceptable tolerance range. An example of one such system is the U.S. Pat. No. 4,807,131 titled "Grading System", assigned to Clegg Engineering Inc., Orange, Calif. This patent discloses a system that measures the elevation of the grading blade relative to the laser plane and displays parameters like target elevation, actual elevation and an allowable tolerance range to the operator. This enables the operator to adjust the position of the blades within the acceptable tolerance range.

However, laser-based systems suffer from a number of drawbacks. First, laser-based systems have a limited range because of the curvature of the Earth, light-incoherence and temperature dependencies of the equipment. The typical range of a laser-based system is less than 3000 ft, which is very small when compared to the average size of agricultural farms.

Second, laser-based systems don't provide any direct measure of accuracy and integrity of the system.

Third, laser-based systems cannot be used continuously for several reasons. As these systems don't provide the horizontal position, the operator requires visible reference markers to guide the vehicle over a field. Hence, these systems cannot be used when the visibility is low (for example at night or on a foggy day) due to the lack of markers and the blockage of the laser beam due to dust and/or fog. Due to this, an operator cannot use these systems round-the-clock.

Fourth, only two-dimensional planar profiles can be achieved using laser-based systems; it is not possible to achieve curved and/or three-dimensional profiles. Curved profiles are critical for proper irrigation in farm fields since the water follows the earth's geoidal shape rather than a flat planar surface.

The Global Positioning System is known to provide accurate and reliable position information. Various systems based on GPS are available for carrying out farming operations like seeding, cultivating, planting and harvesting. These systems use the position information of the work implement (derived from GPS data) and the information relating to the desired topography of the field to calculate the desired position of the work implement. However, none of these systems deal with land-leveling using the Global Positioning System. Some of these systems are described below.

U.S. Pat. No. 6,434,462 titled "GPS control of a tractor towed implement", granted to Deere and Company, Moline, Ill. discloses a system that controls the tractor along with the implement connected to the tractor—a central processor controls the tractor steering actuator and the implement driving actuator.

Another such GPS-based system is disclosed in U.S. Pat. No. 5,764,511 titled "System and method for controlling slope of cut of work implement", granted to Caterpillar Inc. This patent describes a system and method for automatically controlling the position of a work implement, which is movably connected to the vehicle. This system maintains the work implement at a pre-selected slope of cut relative to a geographic surface.

Though the abovementioned patents provide systems that control a tractor and an attached implement, they do not provide specific methods and modes of operation set forth herein for efficient and highly accurate land-leveling. From all the abovementioned systems and patents, it is apparent that there is a need for an efficient and round-the-clock land-leveling system that can achieve three-dimensional land profiles and that has a long range and can operate in different modalities depending on the requirements of the site to be leveled.

SUMMARY

The present invention is directed at a system and method for leveling of land using a satellite navigation system.

An object of the present invention is to provide a land-leveling system with a large area of coverage with acceptable tolerances.

Another object of the present invention is to provide a land-leveling system that can operate when the visibility is zero.

Another object of the present invention is to provide a land-leveling system wherein the cut-regions do not need to be re-surveyed for verification.

A further object of the present invention is to provide a land-leveling system that presents a direct measure of accuracy and integrity of the system to the operator.

Yet another object of the present invention is to provide a method of adjusting the bias between the altitudes of the base station and the work implement.

To achieve the foregoing objects and in accordance with the purposes of the present invention as broadly described herein, the present invention provides for an earth-moving machine mounted with an antenna that receives signals from a satellite navigation system. The earth-moving machine comprises a vehicle attached to a work implement, which is also connected to an actuator. A decision unit mounted on the vehicle sends control signals to the actuator, which controls the elevation of the work implement. These control signals are generated using the signals received from the antenna and the desired grade map.

BRIEF DESCRIPTION OF THE DRAWINGS

The preferred embodiments of the invention will hereinafter be described in conjunction with the appended drawings provided to illustrate and not to limit the invention, wherein like designations denote like elements, and in which.

DESCRIPTION OF PREFERRED EMBODIMENTS

The present invention provides a GPS-based land-leveling system that alters the grade of a field to fit a desired grade map. The system comprises an earth-moving machine, an antenna and a decision unit. The earth-moving machine comprises a vehicle, a work implement and an actuator connected to the work implement. The antenna receives signals from the satellite navigation system and transfers it to the decision unit. The decision unit uses these signals and the desired grade map to generate control signals for the actuator. The actuator alters the elevation of the work implement in accordance with the control signals received from the decision unit.

Figure 1:
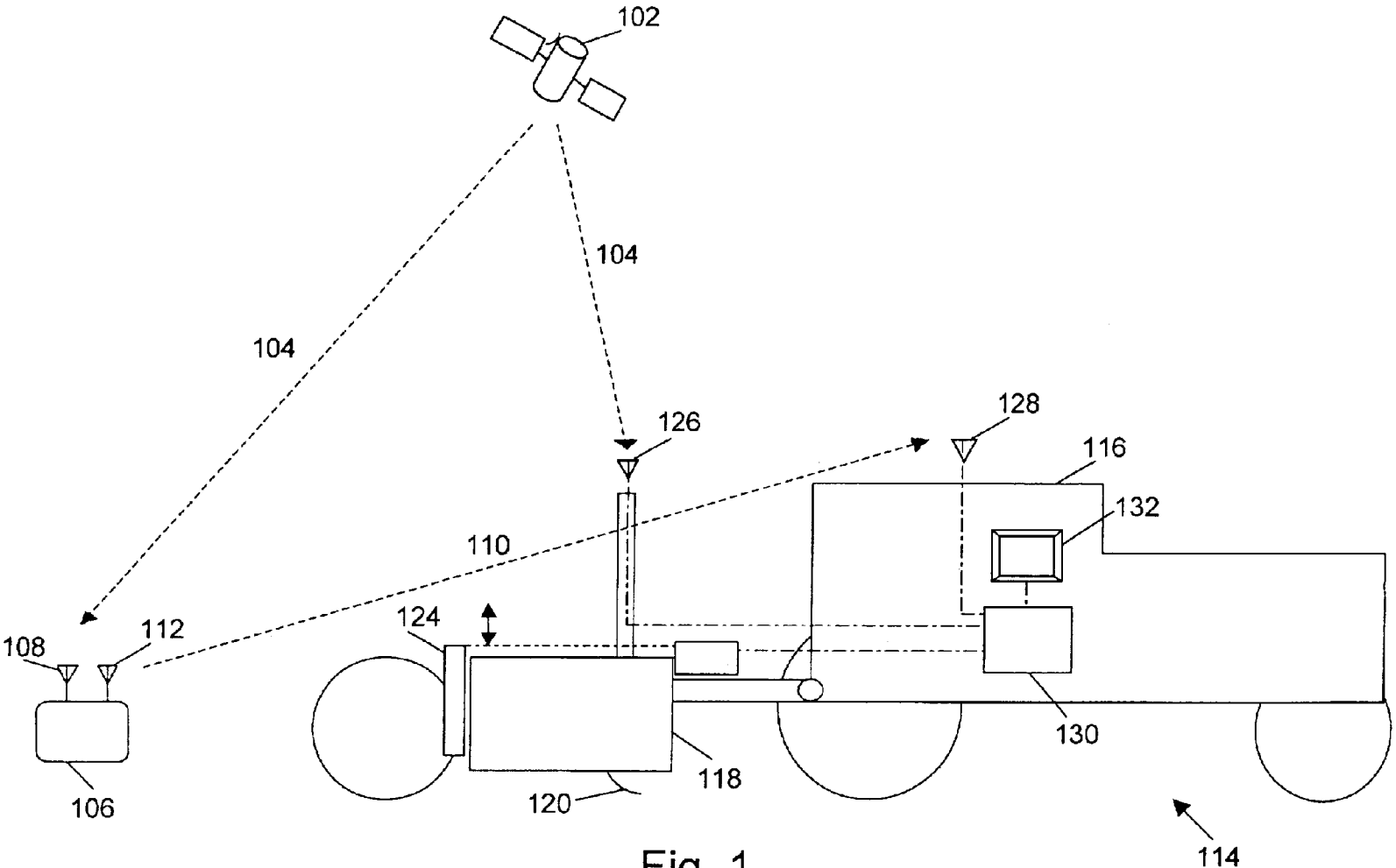
FIG. 1 shows the land-leveling system in accordance with the preferred embodiment of the present invention.

Referring primarily to FIG. 1, an exemplary diagram of the land-leveling system in accordance with a preferred embodiment of the present invention is hereinafter described. The environment in which the system operates comprises a satellite 102, which is a part of a satellite navigation system.

The present invention assumes the satellite navigation system to be the Global Positioning System (GPS). It would be apparent to anyone skilled in the art that the invention can use signals from other satellite or ground based navigation systems such as pseudolite (a pseudolite is a low power transmitter that transmits RF signals at short ranges), Low Earth Orbiting (LEO) satellites, and geo-synchronous satellites such as Wide Area Augmentation System (WAAS), GLobal Orbiting NAvigation Satellite System (GLONASS) and European Global Satellite Navigation System (GALILEO).

The preferred embodiment of the invention uses Real Time Kinematic GPS (RTK-GPS) that uses a Differential GPS (DGPS) base station 106. DGPS base station 106 has a GPS antenna 108 that receives GPS signals 104. Based on these signals, DGPS base station 106 calculates differential corrections and broadcasts differential corrections 110 using transmitter 112.

The figure also shows an earth-moving machine 114 that comprises a vehicle 116 and a work implement 118 attached to it. In a preferred embodiment, a tractor is used as vehicle 116 and a scraper is used as work implement 118. Work implement 118 (or the scraper) has blades 120 for cutting the field. A hydraulic actuator 124 is attached to work implement 118 for raising or lowering work implement 118 so as to adjust the height of blades 120.

A first antenna 126 is mounted on work implement 118; it receives GPS signals from the GPS satellites. In the preferred embodiment, first antenna 126 is mounted on a mast to ensure that GPS signals are not blocked by the structure of earth-moving machine 114. A second antenna 128 is mounted on earth-moving machine 114 and receives differential corrections 110 that are broadcast by transmitter 112.

Earth-moving machine 114 is equipped with a decision unit 130. Decision unit 130 receives signals from first antenna 126 and the differential corrections from second antenna 128. Decision unit 130 uses these signals and the desired grade map to compute the desired height of blades 120. The desired height of blades 120 is captured in control signals that are sent to a hydraulic actuator 124. Hydraulic actuator 124 adjusts the height of blades 120 in accordance with the received control signals.

Decision unit 130 is also attached to a user interface device 132. User interface device 132 allows the operator to switch between manual and automatic control modes. User interface device 132 may be a touch-screen monitor, an LCD display, a set of push buttons or a similar implementation. The preferred embodiment of the present invention employs a touch-screen monitor as a user interface device.

Figure 2:
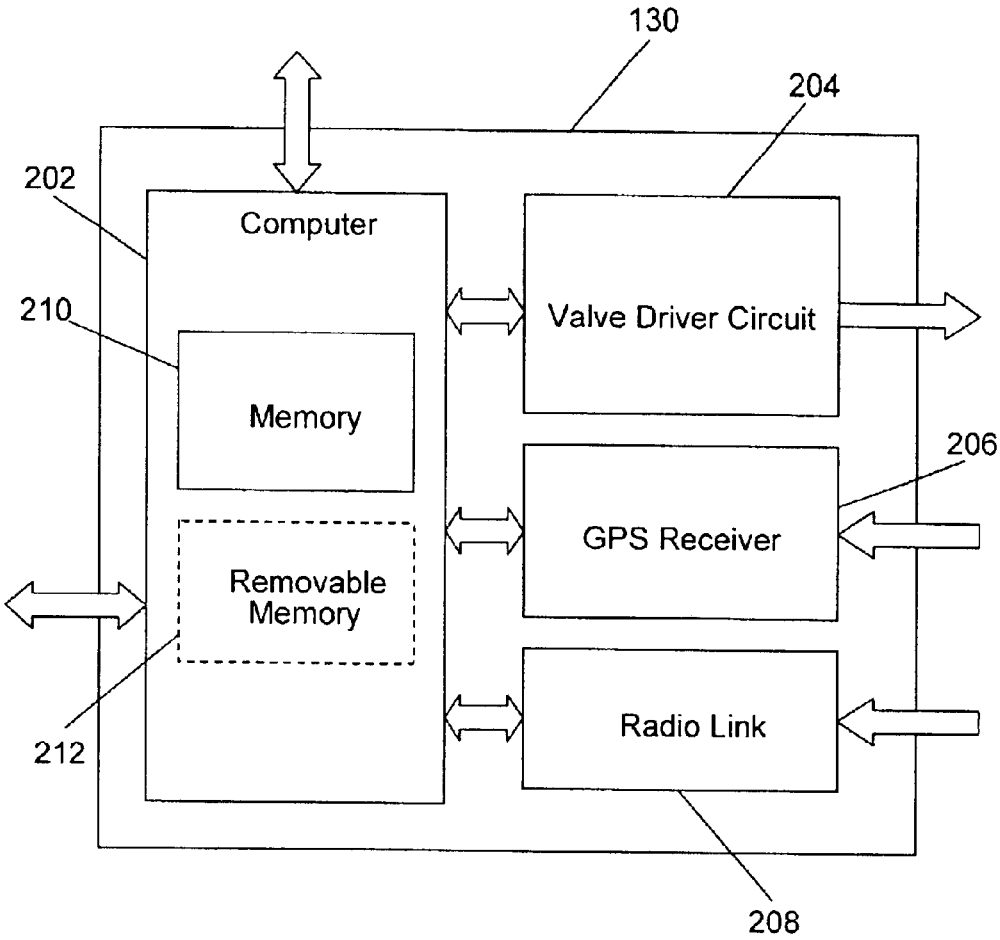
FIG. 2 is a block diagram showing the decision unit.

Referring now primarily to FIG. 2, an exemplary block diagram of decision unit 130 is hereinafter described. Decision unit 130 comprises a computer 202, a valve driver circuit 204, a GPS receiver 206 and a radio link 208.

Computer 202 comprises a memory 210 to be used for storing the process parameters and the desired grade map. The desired grade map may be input into decision unit 130 using computer 202 or radio link 208. Computer 202 has a removable memory 212 that is used to transfer process parameters and the desired grade map data from an external source. In an alternate embodiment, radio link 208 is used for transferring process parameters and the desired grade map data to the system.

Valve driver circuit 204 drives hydraulic actuator 124 by sending control signals to it. Various standard valve driver circuits are known in the art. GPS receiver 206 processes the signals received from first antenna 126 and the differential corrections from second antenna 128 to determine the position of first antenna 126. This position information is passed on to computer 202 for generation of the control signals.

Figure 3:
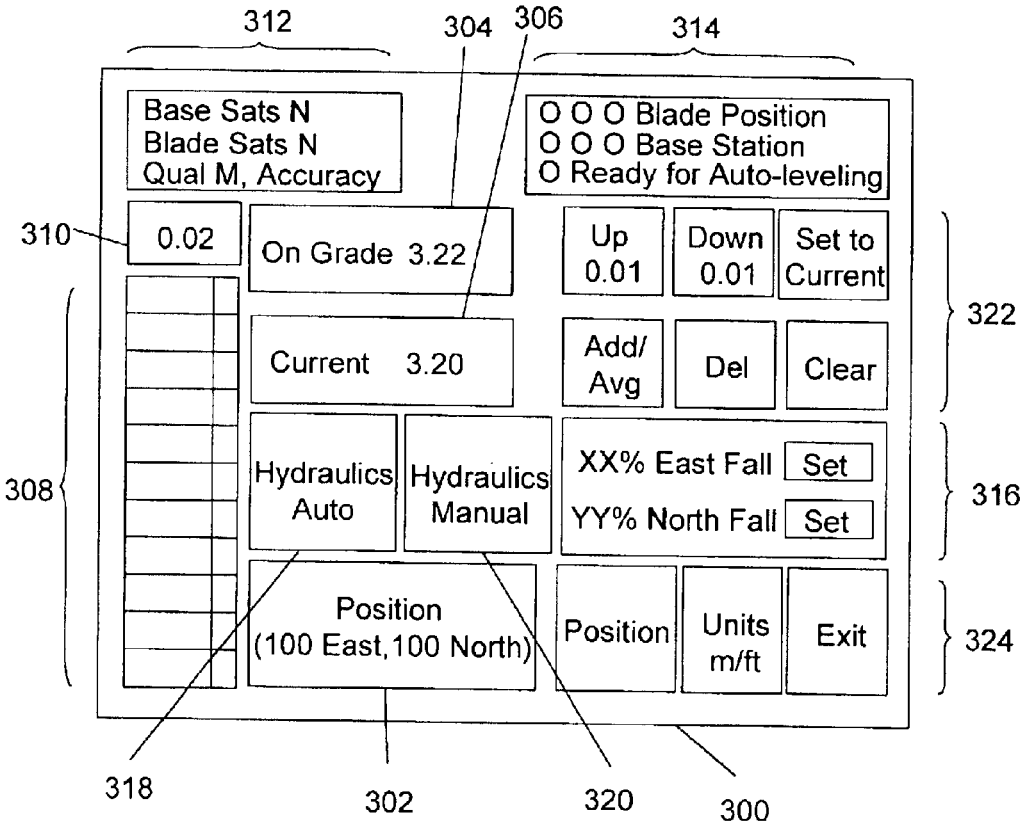
FIG. 3 is an illustrative layout of a sample user interface of the land-leveling system.

Referring now primarily to FIG. 3, an exemplary layout of the panel of user interface device 132 is hereinafter described. The layout is meant to illustrate various options and features rather than the precise organization of the interface. User interface device 132 enables the operator to use the land-leveling information.

User interface device 132 provides the following information: the position of work implement 118 in the field—302; the height of work implement 118 above or below the nominal plane—304 to 310; the status and accuracy of the antenna—312 and 314; and the current slope of the plane being leveled 316.

Text box 304 displays the on-grade elevation of the field. Similarly, text box 306 displays the current elevation of the field. Color bar 308 shows the position of the current grade of the field in the range of tolerance around the on-grade elevation. A green color corresponds to good, while yellow and red colors correspond to marginal and bad regions respectively. Text box 310 shows the difference between the on-grade elevation and the current elevation. All the elevations mentioned above are calculated at the current location of work implement 118.

From top to bottom, information box 312 displays the following: the number of satellites viewed by base station 106, the number of satellites viewed by first antenna 126, and a measure of the current accuracy of the system's position measurement. Information box 314 presents a qualitative status of various system elements using a color scheme. The color scheme is as follows: green represents good, yellow represents marginal and red represents bad.

There are two modes of operation of the land-leveling system: automatic and manual. The mode of operation may be set to automatic using a "Hydraulics Auto" button 318, and to the manual mode by using a "Hydraulics Manual" button 320. The elevation of work implement 118 is controlled by decision unit 130 in automatic mode while the operator controls the elevation himself in the manual mode. The elevation of work implement 118 may be set using a set of buttons 322.

The desired grade plane may be input using control buttons 316. The process parameters such as measurement units and the position of the reference origin may be set using a set of control buttons 324.

Method of Operating the Land-Leveling System

The land-leveling system operates in two modes: laser compatible mode and GPS mode.

In the laser compatible mode of operation, the elevation of the work implement is calculated with respect to a planar surface. The planar surface is defined in a reference frame with origin at the DGPS base station. In an alternate embodiment, the planar surface is defined in a reference frame that has its origin at a virtual point that is different from the physical location of the DGPS base station i.e. to a point wherein a virtual laser tower is located. The location of the virtual laser tower may be input by driving the earth-moving machine to the desired position and recording it. In an alternative embodiment, the position of the virtual laser tower is input by manually entering the position of the virtual laser tower.

The projection of the origin of the reference frame to the position of the virtual laser tower could be achieved in several ways; one of the ways is described below.

The desired virtual laser tower location $L_{enu}$ is defined in a coordinate frame (centered at the physical DGPS base station) that is tangent to the Earth (East-North-Up reference frame) and is represented as:

$$\vec{L}_{enu} = \begin{bmatrix} X_{east} \\ X_{north} \\ X_{up} \end{bmatrix} \tag{1}$$

The above ENU coordinates of the desired virtual laser tower are transformed to the longitude and latitude coordinates ($\theta_{vl}$, $\phi_{vl}$) using methods that are well known in the art.

Similarly, the actual position of the scraper defined in the physical DGPS base station reference frame is represented as:

$$\vec{P}_{enu} = \begin{bmatrix} X_{east} \\ X_{north} \\ X_{up} \end{bmatrix} \tag{2}$$

The actual latitude and longitude of the scraper position may be represented by ($\theta_{bs}$, $\phi_{bs}$).

The position of the scraper in the reference frame tangent to the Earth and originating at the virtual laser tower location is calculated by $$\vec{P}_{vl} = T(\theta_{vl}, \phi_{vl})^T\left[T(\theta_{bs}, \phi_{bs})\{\vec{P}_{enu} - \vec{L}_{enu}\}\right] \tag{3}$$

where, $$T(\theta, \phi) = \begin{bmatrix} -\sin\theta & -\sin\phi\cos\theta & \cos\phi\cos\theta \\ \cos\theta & -\sin\phi\sin\theta & \cos\phi\sin\theta \\ 0 & \cos\phi & \sin\phi \end{bmatrix} \tag{4}$$

The above transformation assumes a simple spherical model of the Earth. It would be apparent to anyone skilled in the art that the calculation can be easily extended to higher order earth models, such as WGS-84 and other geoidal models.

The use of the laser compatible mode of operation makes the set-up and operation of the land-leveling system the same as that of a laser based system. This mode of operation may be used for leveling when a laser-based technique is used for surveying and/or verification of the field.

In the GPS mode of operation, the elevation of the work implement is calculated with respect to a curved surface approximating the surface of the Earth.

Any of the standard models of the Earth may be used for approximating its surface. For purposes of gravitational modeling, the Earth surface is nominally defined in the geoidal sense, but may also be approximated using other models for the surface of the Earth, including but not limited to the WGS-84 reference ellipsoid. A preferred embodiment of the present invention uses a high order geoid model —the National Geodetic Survey's GEOID99.

A method for altering the grade of a field to fit the desired grade map is described henceforth.

The desired grade map defines the desired terrain of the field. It is loaded onto decision unit 130 by either transferring the required data using removable memory 212 or through radio link 208. The desired map may be a linear function of the horizontal location of the work implement or an arbitrary surface relative to the surface approximating the surface of the Earth (planar surface or a curved surface).

The desired grade of the field may be entered in dual-slope input mode or single-slope input mode. In the dual-slope input mode, three parameters are input: the slope of the field in the East direction (East Fall); the slope of the field in the North direction (North Fall); and a number of grade points to validate the desired plane before leveling. In the single-slope input mode, three parameters are input: the slope of the field in the direction of the fall; the direction of the fall in the form of compass heading; and multiple grade points to validate the desired plane before leveling.

Before using the system for leveling the field, the offset height between the DGPS base station and the first antenna needs to be determined. This process is described below.

Determination of the Offset Height

The offset height is the bias between the altitude of DGPS base station 106 and first antenna 126 when the scraper is on-grade with the desired plane. Any field would have several such on-grade points at the boundary between the cut and fill regions. These points are used to determine the offset height.

The procedure for finding out the offset height is as follows. The operator drives the scraper over a location where the cut-and-fill map indicates that the current grade is on-grade (or within a tolerance of on-grade e.g. <0.02 ft). The tolerance depends on the accuracy required from the leveling process. The operator will then manually lower the scraper so as to touch the ground at the final compaction pressure. Thereafter, the height of the current location is added to a running average of the offset height using an "Add/Avg" button 322. This process shall be repeated for several on-grade points distributed around the field until the mean converges (the convergence is determined by computer 202).

Once the offset height has been determined, the land-leveling system is ready to carry out the three steps of land-leveling: surveying, leveling, and verification. A detailed description of these three steps is given below.

Surveying

The first step in land-leveling is the generation of a current map of the field that reflects the current grade of the field. For surveying, the operator places work implement 118 in manual control mode.

The step of surveying is performed by loading the current map of the field from an external source onto the decision unit.

In an alternative embodiment, surveying is done by driving evenly spaced (approximately even) rows over the region of interest and collecting position information over fixed intervals. The spacing of around 100 feet between the rows is required for adequate resolution of the current map. The lesser the spacing between the rows during surveying, the greater would be the resolution of the generated current map. Elevation data of the earth-moving machine is continuously recorded by first antenna 126. A current map of the field is constructed by decision unit 130 using the collected elevation data.

A map depicting the difference between the current map and the desired grade map is thereafter constructed to act as a reference for leveling. This map is a cut-and-fill map that is commonly used in land-leveling: a cut-and-fill map is a grid showing the amount of material that must be added or removed to achieve the desired grade.

Leveling

Once the cut-and-fill map has been generated, the operator may start with leveling the field. For this, the operator needs to make a plan for efficient transfer of soil from the cut-regions to the fill-regions.

The operator drives through the cut-regions making cuts until the scraper is nearly filled with soil. The elevation control of the work implement blades should be set to automatic mode during the cutting operation. When the scraper is full of cut soil while in a cut-region, the operator switches to the manual mode. The operator will then drive the earth-moving machine to a fill-region and unload the soil using the gate/pusher controls.

The operation of cutting and filling is repeated until the field is completely leveled. The process of leveling is stopped when the operator is satisfied that the field is leveled; the operator observes cut-and-fill bar 308 on the user interface device panel for this purpose. The operator may then proceed with the process of verification as described below.

Verification

Verification of the field is performed to ensure that the grade of the processed field matches the desired grade map. The final grade of the field may be verified against the desired grade map by generating a map of the leveled field. A large portion of the field does not need to be re-surveyed for verification: any portion of the field that was originally a cut-region and where new data was collected in automatic-control mode may be considered re-surveyed. While leveling a cut-region, the land-leveling system simultaneously collects the elevation data to generate a map of the leveled cut-region.

The portions of the field covered while the scraper was in manual mode cannot be considered re-surveyed because the scraper may not be touching the ground. Similarly, portions of the field that were originally fill-regions cannot necessarily be deemed re-surveyed since the blade may not be touching the Earth surface while the filling operation is carried out. Therefore, the operator shall re-survey only those portions of the field that were originally the fill-regions. The data collected during the leveling of cut-regions (in automatic mode) and the re-surveying of fill-regions is merged to obtain a map of the leveled field.

Applications and Advantages of the Invention

The present invention has several advantages over existing land-leveling systems.

First, the present invention allows partial overlap of the leveling and verification steps. This reduces the time required for the entire land-leveling process.

Second, the present invention allows leveling operation in a larger area with an acceptable error tolerance. The preferred embodiment of the present invention allows leveling in an area as large as 50,000 acres surrounding the base station.

Third, the present invention can be used even when the visibility is zero.

Fourth, the present invention indicates to the operator the accuracy level of the system (at all points of time). This enables the operator to decide whether or not he should use the land-leveling system.

Fifth, the present invention allows an operator to level a field so that the grade of the field fits any arbitrary surface.

While the preferred embodiments of the invention have been illustrated and described, it will be clear that the invention is not limited to these embodiments only. Numerous modifications, changes, variations, substitutions and equivalents will be apparent to those skilled in the art without departing from the spirit and scope of the invention as described in the claims.

What is claimed is:

1. A system for providing a flat grade to guide alteration of land, the system comprising:

a first antenna operable on an earth moving machine, the first antenna operable to receive signals from a satellite navigation system; and a computer responsive to the signals received by the first antenna, the computer operable to determine a position of the first antenna relative to a planar surface tangent to the Earth as a function of the signals from the satellite navigation system;

wherein the computer is operable in first and second modes of operation, the first mode of operation corresponding to calculating an elevation of a work implement to correspond to the flat grade relative to the planar surface tangent to the Earth, and the second mode of operation corresponding to calculating the elevation of the work implement to correspond to a curved surface approximating a surface of the Earth, the first mode of operation different than the second mode of operation.

2. The system of claim 1 wherein the earth-moving machine comprises a work implement and an actuator connected with the work implement; and wherein the computer is operable to control the actuator such that the work implement elevation corresponds to the flat grade.

3. The system of claim 1 wherein the computer is operable to orient the planar surface tangent to the Earth relative to a virtual point that is different from a physical location of a base station.

4. The system of claim 1 wherein the flat grade is determined as a function of at least one input slope.

5. The system of claim 1 wherein the computer is operable to determine an offset height of the first antenna relative to a base station in response to the earth-moving machine being at an on-grade location.

6. The system of claim 1 wherein the satellite navigation system is selected from the group consisting of: GPS, GLONASS, GALILEO and a pseudolite.

7. A system for providing a flat grade to guide alteration of land, the system comprising:

a first antenna operable on an earth moving machine, the first antenna operable to receive signals from a satellite navigation system; and a computer responsive to the signals received by the first antenna, the computer operable to determine a position of the first antenna in a coordinate frame of reference relative to a curved surface approximating a surface of the Earth as a function of the signals from the satellite navigation system.

8. The system of claim 7 wherein the earth-moving machine comprises a work implement and an actuator connected with the work implement; and wherein the computer is operable to control the actuator such that the work implement elevation corresponds to the flat grade.

9. The system of claim 7 wherein the flat grade is determined as a function of at least one input slope.

10. The system of claim 7 wherein the computer is operable to determine an offset height of the first antenna relative to a base station in response to the earth-moving machine being at an on-grade location.

11. The system of claim 7 wherein the satellite navigation system is selected from the group consisting of: GPS, GLONASS, GALILEO and a pseudolite.

12. A method for providing a flat grade to guide alteration of land, the method comprising:

(a) receiving satellite navigation signals;

(b) determining a flat grade;

(c) leveling a field along the flat grade as a function of the satellite navigation signals; and (d) providing a user with first and second leveling options, the first leveling option being leveling the field relative to a curved surface approximating a surface of the Earth, and the second leveling option being leveling the field relative to a planar surface tangent to the Earth, the first leveling option being a different mode of operation than for the second leveling option.

13. The method of claim 12 further comprising:

(d) controlling an elevation of a work implement as a function of position in the field in response to the satellite navigation signals.

14. The method of claim 12 further comprising:

(d) inputting a slope of the flat grade.

15. The method of claim 12 further comprising:

(d) identifying a location spaced from any base station; and (e) orienting the flat grade relative to the location spaced from any base station.

16. The method of claim 12 further comprising:

(d) positioning an earth-moving machine at an on-grade location; and (e) determining an offset height of an antenna relative to a base station.

17. A system for providing a grade map to guide alteration of land, the system comprising:

a base station;

a first antenna operable on an earth moving machine, the first antenna operable to receive signals from a satellite navigation system; and a computer responsive to the signals received by the first antenna, the computer operable to determine an offset height of the first antenna relative to the base station in response to the first antenna being at an on-grade location.

18. The system of claim 17 wherein the computer is operable to determine the offset height in response to the first antenna being at the on-grade location and subsequently at an additional on-grade location.

19. The system of claim 17 wherein the computer is operable to determine a position of the first antenna relative to a planar surface tangent to the Earth as a function of the signals from the satellite navigation system.

20. A method for providing a grade map to guide alteration of land, the method comprising:

(a) receiving satellite navigation signals;

(b) determining a position on a grade map as a function of the satellite navigation signals;

(c) positioning an earth-moving machine at an on-grade location; and (d) determining an offset height of an antenna relative to a base station as a function of the satellite navigation signals received during (c).

21. The method of claim 20 further comprising:

(e) positioning the earth-moving machine at an additional on-grade location after (c);

wherein (d) comprises determining the offset height as a function of the satellite navigation signals received during (c) and (e).

22. A system for providing a flat grade to guide alteration of land, the system comprising:

a first antenna operable on an earth moving machine, the first antenna operable to receive signals from a satellite navigation system; and a computer responsive to the signals received by the first antenna, the computer operable to determine a position of the first antenna relative to the flat map as a function of the signals from the satellite navigation system;

wherein the flat grade is determined as a function of at least one input slope.

23. The system of claim 22 wherein the flat grade is determined as a function of at least two input slopes.

24. The system of claim 22 wherein the flat grade is determined as a function of the slope of a planar surface and a slope direction.

25. A method for providing a flat grade to guide alteration of land, the method comprising:

(a) receiving satellite navigation signals;

(b) inputting a slope of the flat grade; and (c) determining a position on the flat grade as a function of the satellite navigation signals and the input slope.

26. The method of claim 25 wherein (b) comprises inputting two slopes and wherein (c) comprises determining a position on the flat grade as a function of the satellite navigation signals and the two slopes.

27. The method of claim 25 wherein (b) comprises inputting the slope of a planar surface and a slope direction.

* * * * *

UNITED STATES PATENT AND TRADEMARK OFFICE

CERTIFICATE OF CORRECTION

PATENT NO. : 6,880,643 B1
APPLICATION NO. : 10/359409
DATED : April 19, 2005
INVENTOR(S) : Kurt R. Zimmerman et al.

It is certified that error appears in the above-identified patent and that said Letters Patent is hereby corrected as shown below:

In the Claims

Column 9, in claim 13, line 2, before "controlling an elevation" delete "(d)" and substitute --(e)-- in its place.

Column 10, in claim 14, line 2, before "inputting a slope" delete "(d)" and substitute --(e)-- in its place.

Column 10, in claim 15, line 2, before "identifying a location" delete "(d)" and substitute --(e)-- in its place.

Column 10, in claim 15, line 4, before "orienting the flat" delete "(e)" and substitute --(f)-- in its place.

Column 10, in claim 16, line 2, before "positioning an earth-moving" delete "(d)" and substitute --(e)-- in its place.

Column 10, in claim 16, line 4, before "determining an offset" delete "(e)" and substitute --(f)-- in its place.

Signed and Sealed this

Thirteenth Day of November, 2007

JON W. DUDAS
*Director of the United States Patent and Trademark Office*